US006360782B1

(12) United States Patent
Yoshitoshi et al.

(10) Patent No.: US 6,360,782 B1
(45) Date of Patent: Mar. 26, 2002

(54) EXHAUST PIPE ASSEMBLY OF TWO-PASSAGE CONSTRUCTION

(75) Inventors: Nobuyuki Yoshitoshi; Akihiro Suzuki; Kazuhiro Furuhashi; Hiroto Yanagibayashi; Kazuo Ishii; Takeshi Munemura; Masayuki Uegane; Yoshihiko Eguchi, all of Tochigi-ken (JP)

(73) Assignees: Kabushiki Kaisha Yutaka Giken, Shizuoka-ken; Honda Giken Kogyo Kabushiki Kaisha, Tokyo, both of (JP)

( * ) Notice: Subject to any disclaimer, the term of this patent is extended or adjusted under 35 U.S.C. 154(b) by 0 days.

(21) Appl. No.: 09/680,299

(22) Filed: Oct. 6, 2000

(30) Foreign Application Priority Data

Oct. 8, 1999 (JP) ..... 11-288305
Oct. 8, 1999 (JP) ..... 11-288306

(51) Int. Cl.[7] ..... F16L 9/18

(52) U.S. Cl. ..... 138/115; 138/116; 138/109; 138/177

(58) Field of Search ..... 138/116, 115, 138/117, 148, 109, 177, 114

(56) References Cited

U.S. PATENT DOCUMENTS 2,929,408 A * 3/1960 Weatherwax et al. ... 138/115 X
3,163,710 A * 12/1964 Witort ..... 138/116
6,283,159 B1 * 9/2001 Tada ..... 138/116

FOREIGN PATENT DOCUMENTS

JP 9-192727 7/1997

* cited by examiner

*Primary Examiner*—Patrick Brinson
(74) *Attorney, Agent, or Firm*—Armstrong, Westerman & Hattori, LLP

(57) ABSTRACT

An exhaust pipe assembly of two-passage and double-pipe construction has an inner pipe; a partition plate meeting the inner pipe at both diametrical meeting ends thereof so as to be elongated in a longitudinal direction of the inner pipe. Two passages divided across a diameter of said inner pipe are thus formed. The assembly also has an outer pipe which covers the inner pipe with a thermally insulating space around a periphery of the inner pipe. The outer pipe has on one longitudinal end thereof a connecting portion for connection with a mating member. One end of the inner pipe is fixedly connected to the outer pipe with a clearance between the periphery of the inner pipe near each of the meeting ends and an inner circumference of the outer pipe.

18 Claims, 8 Drawing Sheets

EXHAUST PIPE ASSEMBLY OF TWO-PASSAGE CONSTRUCTION

BACKGROUND OF THE INVENTION

1. Field of the Invention

The present invention relates to an exhaust pipe assembly which is suitable for connection between an exhaust manifold of a multi-cylinder internal combustion engine of a motor vehicle and a catalyst converter. In particular, it relates to an exhaust pipe assembly employing a two-passage construction in general in which a so-called Θ pipe, whose exhaust passage is divided into two by a partition plate, is used in order to prevent the exhaust interference among the cylinders. It also relates to an exhaust pipe assembly employing a double-pipe construction in order to prevent the exhaust gas from lowering in temperature before it reaches a catalytic converter and to prevent personal harms due to high temperature.

2. Description of Related Art

In order to prevent the exhaust interference among the cylinders and to prevent the heat dissipation, an exhaust pipe assembly of two-passage and double-pipe construction is known, for example, from Published Unexamined Japanese Patent Application No. 192727/1997. This kind of conventional exhaust pipe assembly as shown by reference alphabet E in FIG. 10A is connected to a flange f2 of an exhaust manifold M of a multi-cylinder internal combustion engine (not illustrated). The exhaust pipe assembly E is made up of an inner pipe "a" and an outer pipe b which are welded to a flange f1. A partition plate c is elongated in a longitudinal direction of the inner pipe "a" so as to form two exhaust passages g1, g2 divided along the diameter of the inner pipe "a." A thermally insulating space e is provided between the periphery (i.e., outer surface) of the inner pipe "a" and the inner circumference of the outer pipe b. The partition plate c is, in most cases, welded by laser beam welding to an extended piece c1 from an outside. A small curvature R is formed at a base portion of that partition plate c which comes into contact with the extended piece c1 to facilitate the deformation of the partition plate c. The thermal expansion is thus absorbed by the extended piece c1 which is provided on each of the diametrically opposite ends.

That portion of the partition plate c which lies on the side of the flange f1 is exposed most frequently to the high-temperature exhaust gas as compared with a portion of the inner pipe "a" and the flange f1, whereby a maximum thermal expansion occurs therein. However, the portion in question of the partition plate c is welded to a slip-on or inserting hole of the flange f1 together with the inner pipe "a" and is therefore restricted in its expansion in the diametrical direction. Therefore, the partition plate c gives rise to buckling and deformation, as shown by dotted lines in FIG. 10B, and the exhaust passages g1, g2 are subject to changes in shape. As a result, there is a possibility that the exhaust passages in the exhaust pipe assembly E differ from those in the exhaust manifold M. In addition, when the welded portions in the extended pieces c1 try to be displaced as a result of the deformation in the partition plate c, the inner pipe "a" cannot follow the deformation. The welded portion thus sometimes gives rise to peeling, with the resultant poor sealing effect. Further, as a result of repeated bending loads due to thermal expansion and contraction, the welded portion may give rise to fatigue rupture and the partition plate c may be damaged due to fatigue. In any of the above-described cases, the engine output and the torque decrease.

In view of the above points, the present invention has an object of providing an exhaust pipe assembly of two-passage construction.

SUMMARY OF THE INVENTION

In order to attain the above and other objects, according to one aspect of the present invention, there is provided an exhaust pipe assembly of two-passage and double-pipe construction, comprising: an inner pipe; a partition plate meeting the inner pipe at both diametrical meeting ends thereof so as to be elongated in a longitudinal direction of the inner pipe, whereby two passages divided across a diameter of the inner pipe are formed; an outer pipe covering the inner pipe with a thermally insulating space around a periphery of the inner pipe, the outer pipe having on one longitudinal end thereof a connecting portion for connection with a mating member, wherein one end of the inner pipe is fixedly connected to the outer pipe with a clearance between the periphery of the inner pipe near each of the meeting ends and an inner circumference of the outer pipe.

Preferably, the exhaust pipe assembly further comprises a connecting member provided at the connecting portion, for connecting the exhaust pipe assembly to the mating member.

The inner pipe at the connecting portion is preferably formed into a substantially true circle and the outer pipe at the connecting portion is formed into an ellipse having a larger diameter in a direction of the partition plate, whereby the clearance is formed between the inner pipe and the outer pipe. Alternatively, the inner pipe at the connecting portion may be formed into an ellipse having a smaller diameter in the direction of the partition plate and the outer pipe at the connecting portion may be formed into a substantially true circle so that the clearance is formed between the inner pipe and the outer pipe.

Further, preferably the inner pipe and the partition plate are formed by a single plate material which is bent substantially into a configuration of an alphabet "S" or of a cocoon in cross section.

According to the above-described arrangement, although the partition plate is thermally extended in an amount larger than that of the inner pipe to thereby urge the inner pipe radially outward, the thermal expansion takes place inside the clearance. Therefore, the resistance of the inner pipe against the deformation due to the thermal expansion of the partition plate is smaller and the thermal stress is thus small.

According to another aspect of the present invention, there is provided an exhaust pipe assembly of two-passage and double-pipe construction, comprising: an inner pipe; a partition plate meeting the inner pipe at both diametrical meeting ends thereof so as to be elongated in a longitudinal direction of the inner pipe, whereby two passages divided across a diameter of the inner pipe are formed; an outer pipe covering the inner pipe with a thermally insulating space around a periphery of the inner pipe, wherein the outer pipe has on one longitudinal end thereof a connecting portion for connection with a mating member, and wherein the outer pipe is fixed to the periphery of the inner pipe at a short distance toward a downstream side from the connecting portion while leaving a clearance at the connecting portion between the inner pipe and the outer pipe.

Preferably, the holding portion is formed by reducing a diameter of the outer pipe into close contact with the periphery of the inner pipe. The exhaust pipe preferably further comprises a connecting member provided at the connecting portion which is for connecting the exhaust pipe to the mating member. The inner pipe and the outer pipe at the connecting portion may be formed concentric with each other. Still furthermore, the inner pipe and the partition plate may be formed by a single plate material which is bent substantially into a configuration of an alphabet "S."

According to the above arrangement, the partition plate can be thermally extended into the clearance between the inner pipe and the outer pipe. Further, since the inner pipe and the outer pipe are formed into concentric with each other, the machining is relatively easy.

According to still another aspect of the present invention, there is provided an exhaust pipe assembly of two-passage construction, comprising: an exhaust pipe; a partition plate meeting the exhaust pipe at both diametrical meeting ends thereof so as to be elongated in a longitudinal direction of the exhaust pipe, whereby two passages divided across a diameter of the exhaust pipe are formed; a cover member surrounding a periphery of one longitudinal end of the exhaust pipe, wherein the cover member is fixedly connected to the exhaust pipe at one end of the cover member with a clearance between the periphery of the exhaust pipe and an inner circumference of the cover member, the other end of the cover member and said one longitudinal end of the exhaust pipe forming a connecting portion for connection with a mating member.

Preferably, the cover member is fixedly connected to the exhaust pipe at that end of the cover member which is on a downstream end of the exhaust pipe.

The exhaust pipe assembly preferably further comprise a connecting member provided at the connecting portion which is for connecting the exhaust pipe assembly to the mating member.

Still furthermore, the inner pipe and the partition plate may be formed by a single plate material which is bent substantially into a configuration of an alphabet "S" .

According to this arrangement, the exhaust pipe of two-passage construction can be connected to the mating member by means of the cover member while allowing for the thermal expansion of the inner pipe and the partition plate into the clearance between the inner pipe and the outer pipe.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

A detailed explanation will now be made about preferred embodiments of the present invention with reference to the accompanying drawings.

Figure 1:
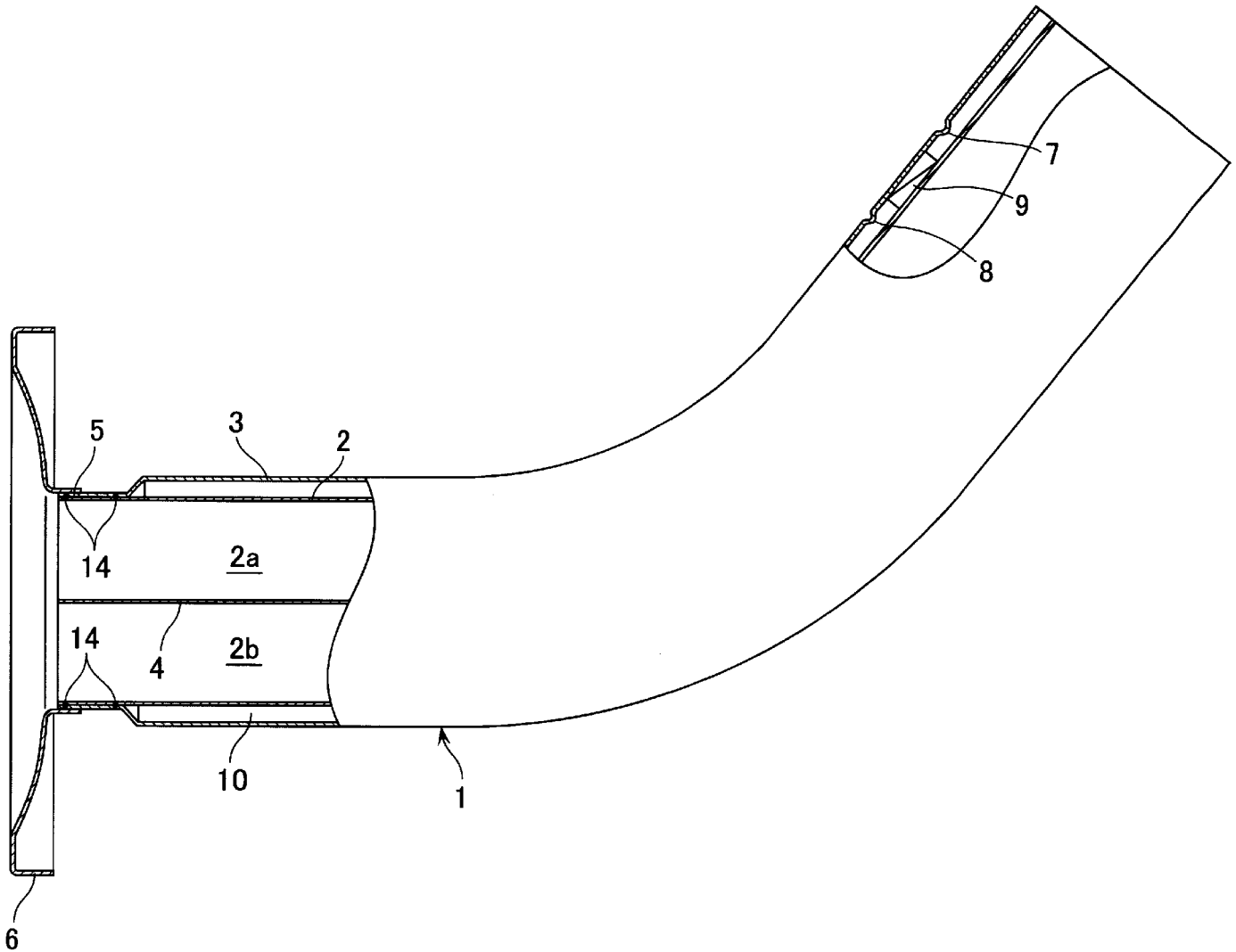
FIG. 1 is a longitudinal sectional view of an exhaust pipe assembly of two-passage and dual-pipe construction according to one example of the present invention.
Figure 2:
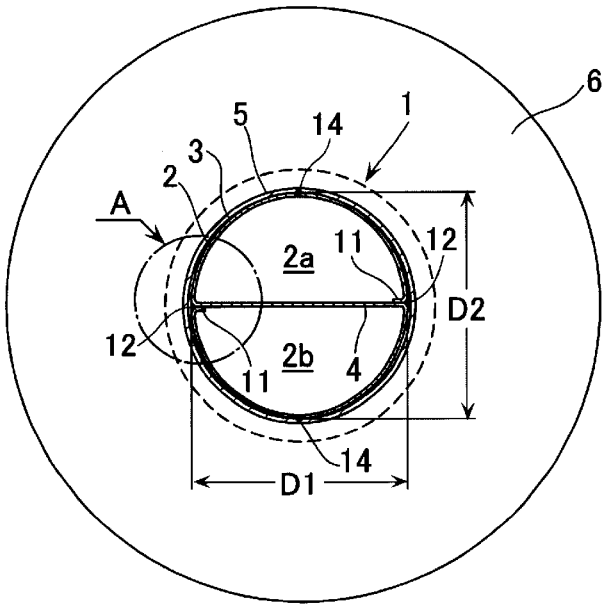
FIG. 2 is an end view of FIG. 1.
Figure 3:
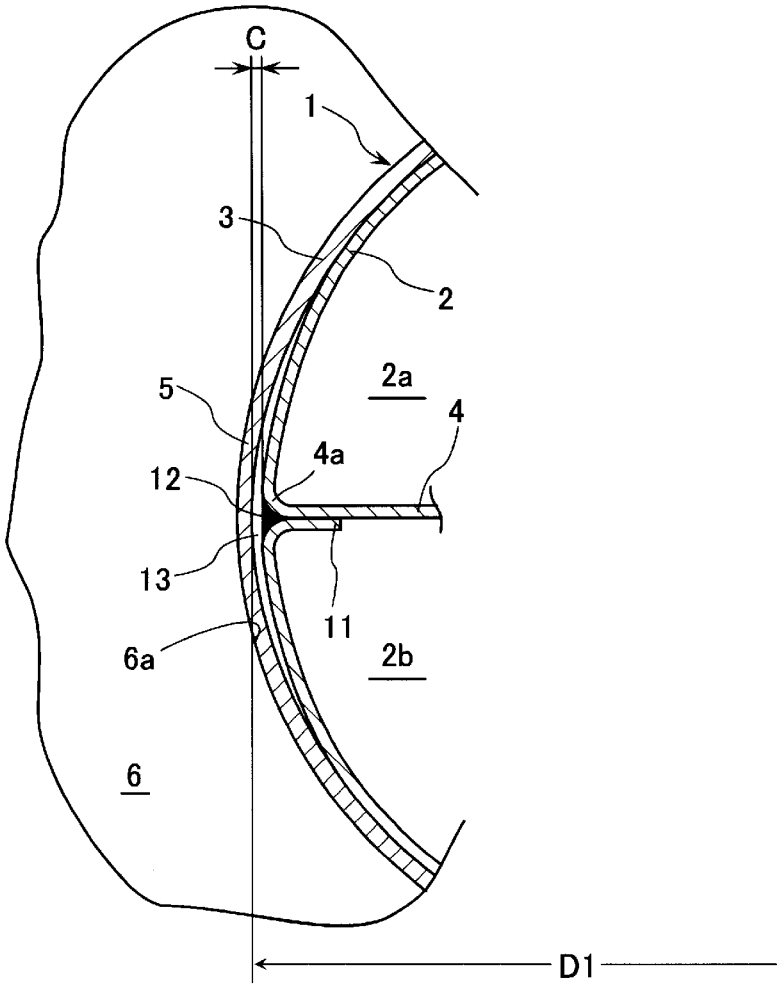
FIG. 3 is an enlarged view of portion "A" in FIG. 2.

FIGS. 1 through 3 show one example of the present invention in which the exhaust pipe assembly is of a two-passage and double-pipe construction.

In FIG. 1, reference numeral 1 denotes a pipe main body of an exhaust pipe assembly of two-passage and double-pipe construction for use in an exhaust-gas system for an internal combustion engine of a motor vehicle. Reference numeral 2 denotes an inner pipe. Reference numeral 3 denotes an outer pipe which is disposed on a periphery (i.e., outer circumference) of the inner pipe 2. Reference numeral 4 denotes a partition plate which extends in a diametrical direction of the inner pipe 2 so as to meet the inner pipe 2 at the diametrically opposite meeting ends 4*a*, 4*a* (see FIG. 3). The partition plate 4 is thus disposed inside the inner pipe 2 such that the inner pipe 2 is divided along a longitudinal direction of the inner pipe 2. The inner pipe 2 is therefore divided along the diameter of the inner pipe 2 into two passages 2*a*, 2*b* for passing exhaust gas therethrough. On a left end (as seen in FIG. 1) of the pipe main body 1, the outer pipe 3 is reduced in diameter so that the outer pipe 3 substantially comes into close contact with the periphery of the inner pipe 2. A connecting portion 5 of a smaller diameter is thus formed. A flange 6, which is also defined as a connecting member, is then fitted or slipped onto the periphery of this connecting portion 5 and is welded together. The flange 6 is then connected to a collecting pipe portion of an exhaust manifold through a mating member such as a mating flange (not illustrated). Near a right end portion (as seen in FIG. 1) of the pipe main body 1, inward projections 7, 8 are partially formed on the inner circumference of the outer pipe 3. A spacer 9 made of a wire mesh is filled into a space between the periphery of the inner pipe 2 and the inner circumference of the outer pipe 3 within a range between the projections 7, 8. A thermally insulating space 10 is thus formed between the spacer 9 and the connecting portion 5 on the left end of the pipe main body 1.

In the above-described example, the connecting portion 5 is connected to the mating member through a pair of flanges (one of the pair is not illustrated). However, the connecting portion 5 may be directly connected to the mating member which is in the form of an exhaust manifold of the engine, without using flanges at all.

As can be seen from FIGS. 2 and 3, the inner pipe 2 and the partition plate 4 are made of a single piece of plate material. The plate material is bent into a configuration which looks substantially like an alphabet "S" in its cross section. In other words, starting from one circumferential end (as seen in FIG. 2), an upper semicircular section, a horizontal plate section, and a lower semicircular section are formed in a continuous manner. At both starting end and finishing end of the "S" configuration, there are formed slightly bent extended pieces 11, 11. These extended pieces 11, 11 are arranged to be in close contact with respective flat end portions (i.e., at diametrically opposite ends) of the horizontal plate section of the partition plate 4. In this manner, a meeting end 4*a* is formed on each of the diametrical ends of the partition plate 4. The "meeting end" is used in a sense that the partition plate 4 and the circumferential portion of the inner pipe 2 meet together. The meeting end (or a base end portion) 4*a* of the partition plate 4, on each diametrical end thereof, is combined by welding at a welded portion 12. In this manner, the inner-pipe 2 of true circle and the partition plate 4 of a flat shape are formed.

On the other hand, the outer pipe 3 at the connecting portion 5 is reduced in diameter as described hereinabove, and is further formed into an ellipse which has a larger diameter D1 in the direction of the partition plate 4 (i.e., in the direction in which the partition plate 4 diametrically extends) and a smaller diameter D2 in the direction perpendicular to the diameter D1. When the connecting portion 5 is fitted into the inner pipe 2, a clearance 13 occurs between the periphery (or the outer surface) of the inner pipe 2 and the inner circumference of the outer pipe 3 near each of the meeting ends 4*a* of the partition plate 4 and the inner pipe 2. In the remaining range of the connecting portion 5, however, the inner pipe 2 and the outer pipe 3 are brought into close contact with each other and are welded at two welded portions 14 on each of the short-diameter portions. The maximum size of the clearance C is set to a value which takes into consideration the thermal expansion. For example, when the inner diameter of the inner pipe 2 is 66 mm, the clearance C is set to a range of 0.55 mm through 0.75 mm. The connecting portion 5 is fitted into the true-circle inserting hole 6*a* of the flange 6 and welded together, but the outer pipe 3 is maintained in the elliptic shape and is welded as it is to the flange 6. The clearance between the periphery of the short-diameter portion of the outer pipe 3 and the inserting hole 6*a* of the flange 6 is filled by welding seams. However, the clearance 13 remains as it is on each of the diametrical ends so as to facilitate the thermal expansion of the partition plate 4. This clearance 13 is extremely small in size and, therefore, the exhaust gas flowing into this clearance goes out into a catalytic converter (not illustrated).

When an engine of the motor vehicle is started, the exhaust gas alternately flows into the exhaust passages 2*a*, 2*b*. As a result, the semicircular cylindrical surfaces in the inner pipe 2 are intermittently heated. The partition plate 4, on the other hand, is alternately heated by the exhaust gas to pass along both surfaces of the partition plate 4 to thereby attain the highest temperature. The partition plate 4 thus thermally expands in the widthwise (i.e., diametrical) direction in a magnitude which is larger than those of the inner pipe 2 and the outer pipe 3. As a result, the inner pipe 2 near the meeting ends 4*a* is forcibly bent outward. However, since the bending takes place only in the clearance 13, the resistance against the thermal expansion of the partition plate 4 is small, and a stress which occurs in the partition plate 4 or in the meeting ends 4*a* is small. In this manner, there is no possibility of occurrence of damages due to buckling, deformation, peeling, or the like.

Figure 4:
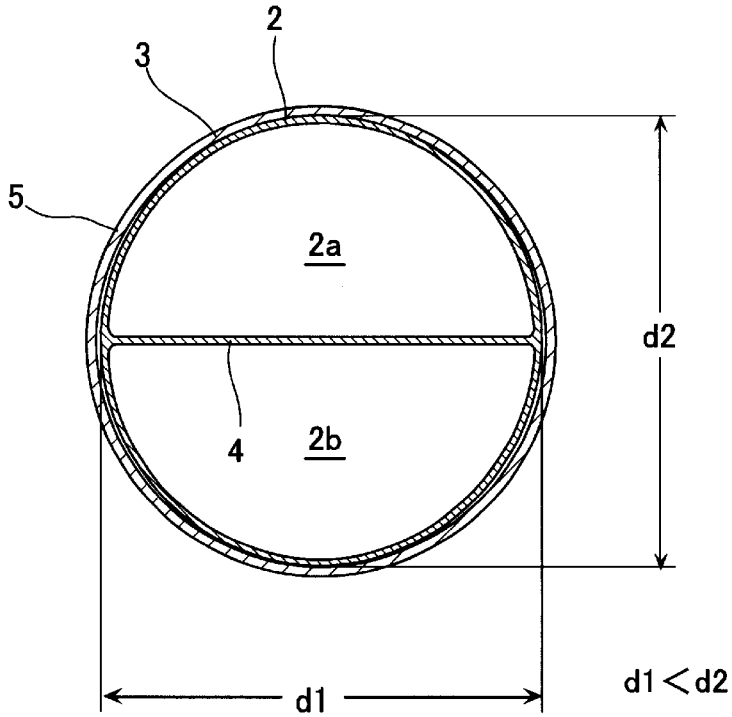
FIG. 4 is an end view of a modified example of the present invention.

In a modified example in FIG. 4, the outer pipe 3 is formed into a true circle and the inner pipe 2 is formed into an ellipse in which the diameter d1 in the direction in which the partition plate 4 extends is smaller than the diameter d2 in the direction which is perpendicular to d1. A clearance 13 is thus formed on an extended line of the partition plate 4, and has the same effect as in the example shown in FIGS. 1 through 3. The partition plate 4 in this example is not the same as that in FIGS. 2 and 3. Namely, it is not formed by bending a single plate.

Figure 5:
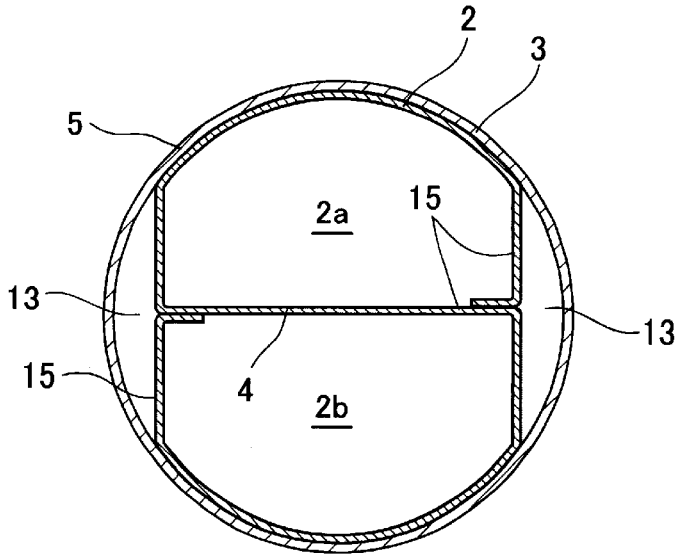
FIG. 5 is an end view of another modified example of the present invention.
Figure 6:
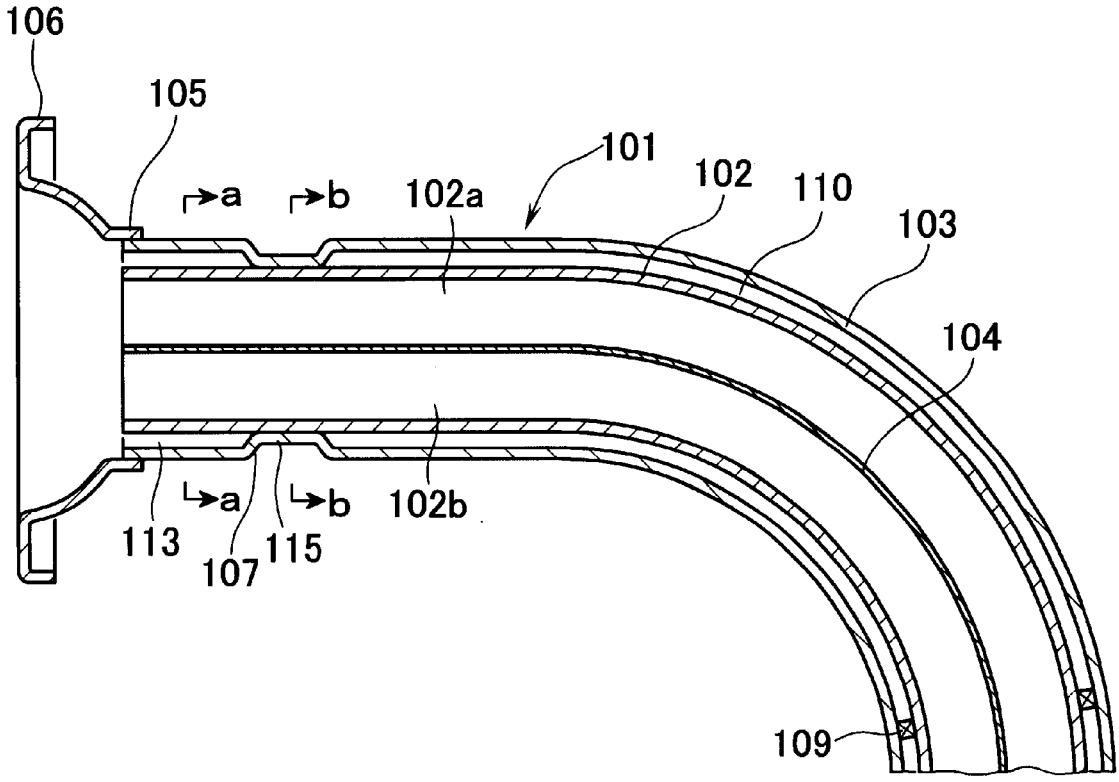
FIG. 6 is a longitudinal sectional view of an exhaust pipe assembly of two-passage and dual-pipe construction according to another example of an exhaust pipe assembly of two-passage and dual-pipe construction.

In another modified example shown in FIG. 5, the neighborhood of the meeting end 4*a* of the partition plate 4 of the inner pipe 2 is formed into a flat plane so that the inner pipe 2 as a whole looks substantially like, in cross section, an oval or a shape like a cocoon. The effects thereof are substantially the same as those of the above-described examples.

As still another modified example, though not illustrated, the shape of the outer pipe 3 may be formed as follows instead of the elliptic shape in FIGS. 1 through 3. Namely, the neighborhood of the large-diameter portion of the illustrated ellipse is formed into a stepped shape made up of a smaller circular portion and a circular portion which is slightly larger in diameter than the smaller circular portion. The clearance 13 can thus be formed by the space formed in the stepped portion.

Figure 7A:
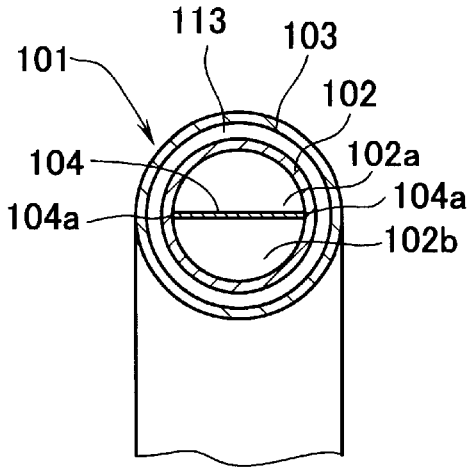
FIG. 7A is a sectional view of the example of FIG. 6 as seen in a direction of an arrow "a"—"a" in FIG. 6.
Figure 7B:
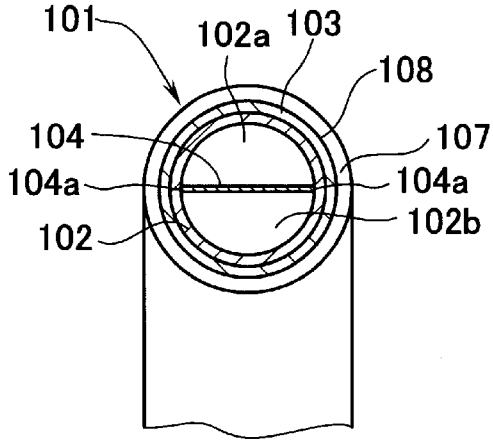
FIG. 7B is a sectional view thereof as seen in a direction of an arrow "b"—"b" in FIG. 6.

As a further modified example of the above described invention of two-passage and double-pipe construction, there can be employed the following arrangement as shown in FIG. 6 and FIGS. 7A through 7D. Namely, reference numeral 101 denotes a pipe main body of an exhaust pipe assembly of two-passage and double-pipe construction. Reference numeral 102 denotes an inner pipe. Reference numeral 103 denotes an outer pipe which is disposed on a periphery of the inner pipe 102. Reference numeral 104 denotes a partition plate which extends in the diametrical direction of the inner pipe 102 so as to meet the inner pipe 102 at the diametrically opposite meeting ends 104*a*, 104*a*. The partition plate 104 is thus disposed inside the inner pipe 102 such that the inner pipe 102 is divided along a longitudinal direction of the inner pipe 102. The inner pipe 102 is thus divided along the diameter of the inner pipe into two passages 102*a*, 102*b* for passing exhaust gas therethrough. The outer pipe 103 has a ring-shaped reduced-diameter portion 107 in which the inner circumference of the outer pipe 103 comes into close contact with the periphery of the inner pipe 102 as shown in FIG. 7B for further fixing them together, e.g., by means of welding or the like. This reduced-diameter portion 107 thus serves as a fixedly holding portion 115 to hold the inner pipe 102 and the outer pipe 103 together. The inner pipe 102 and the outer pipe 103 are disposed in a concentric relationship with each other. Therefore, the upstream portion of this reduced diameter portion 107 forms a clearance 113 between the periphery of the inner pipe 102 and the inner circumference of the outer pipe 103. The outer pipe 103 on the upstream end at the connecting portion 105 is connected to a flange 106 which is for further connection to a mating member such as a mating flange (not illustrated) on the side of the an exhaust manifold. The upstream end of the inner pipe 102 is left free from connection to the flange 106. This holding portion 115 may be formed on a downstream side of the connecting portion 105 at a short distance therefrom. This distance may be conveniently determined on a case by case basis so as to secure the connection to the flange 106 or the like.

The above-described clearance 113 serves to receive therein the thermally extended inner pipe 102, especially at those diametrical ends of the partition plate 104 which are subject to larger thermal expansions.

Figure 7C:
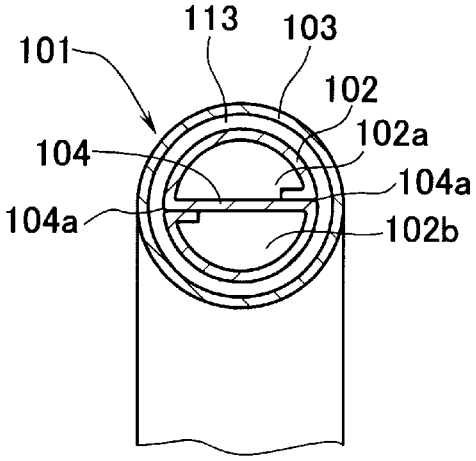
FIG. 7C is a modified example of the present invention as seen in a direction of an arrow "a"—"a" in FIG. 6.
Figure 7D:
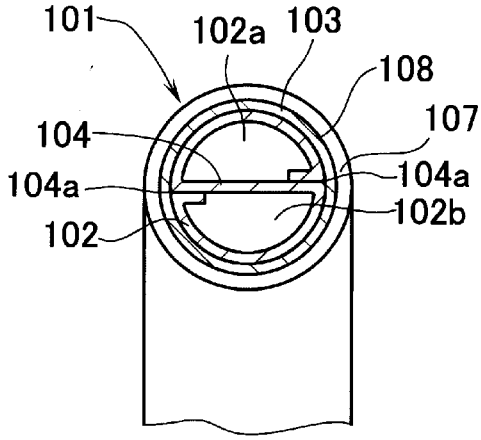
FIG. 7D is a sectional view as seen in a direction of an arrow "b"—"b" in FIG. 6.

The partition plate 104 may be formed either into an integral construction as shown in FIGS. 7A and 7B, or into he configuration of an alphabet "S" or of a cocoon in cross section as shown in FIGS. 7C and 7D.

An explanation has so far been made about the examples in which the exhaust pipe assembly has a double-pipe construction. The present invention is not limited to the double-pipe construction, but can also be applied to a single-pipe construction as described hereinbelow with reference to FIGS. 8 and 9A through 9D.

Figure 8:
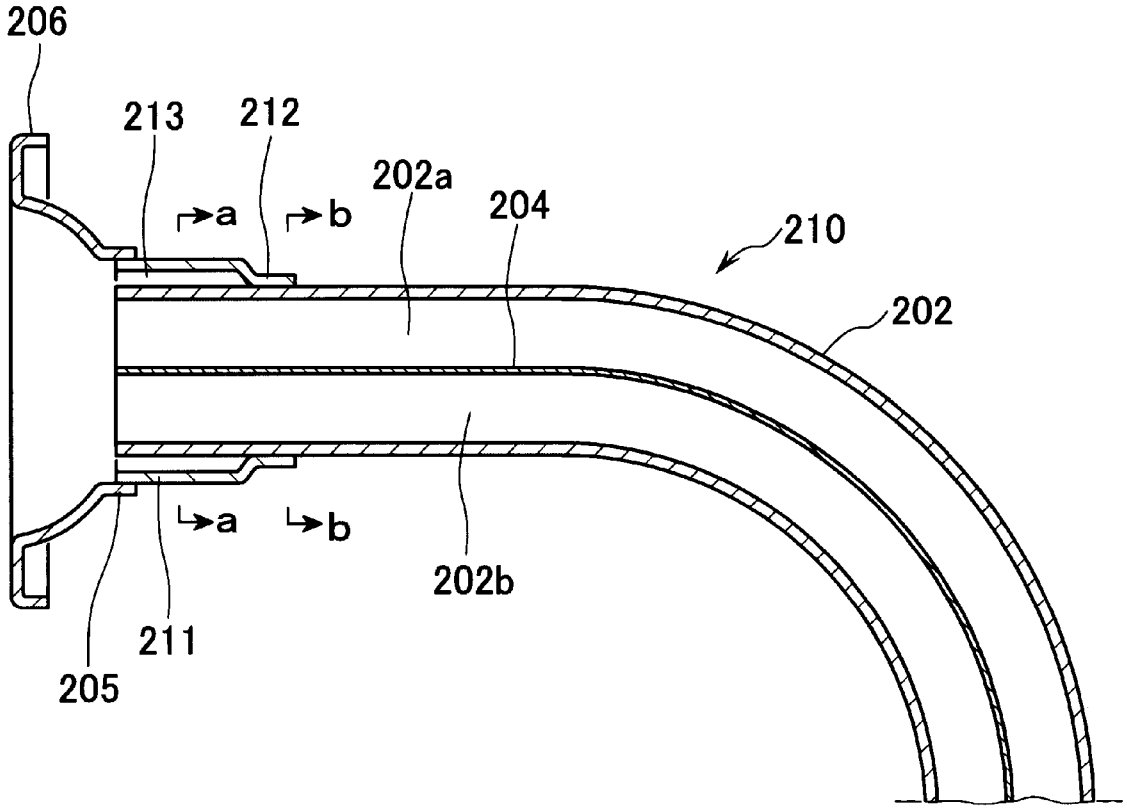
FIG. 8 is a longitudinal sectional view of an exhaust pipe assembly of two-passage construction according to another example of the present invention.

An exhaust pipe assembly in FIG. 8 has an exhaust pipe 210. Inside this exhaust pipe 210, there is disposed a partition plate 204 which meets the exhaust pipe 210 at both diametrical meeting ends 204*a*, 204*a* of the partition plate 204 so as to be elongated in a longitudinal direction of the exhaust pipe 210. The exhaust pipe 210 is thus divided into two passages 210*a*, 210*b* across the diameter of the exhaust pipe 210. This arrangement is substantially the same as that of the inner pipe and the partition plate in the above-described double-pipe construction.

On an upstream end (left end in FIG. 8), there is provided a cover member 211 which covers the periphery of the upstream end of the exhaust pipe 210 with a clearance 213 therebetween. The downstream end of the cover member 211 is reduced in diameter so as to come into close contact with the periphery of the exhaust pipe 210, and is fixed thereto by means of welding or the like. In this manner, a connecting portion 205 for connection to a flange 206 is formed.

Figure 9A:
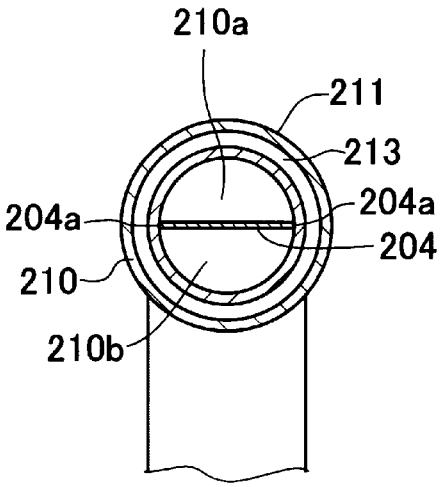
FIG. 9A is a sectional view of the example of FIG. 8 as seen in a direction of an arrow "a"—"a" in FIG. 8.
Figure 9B:
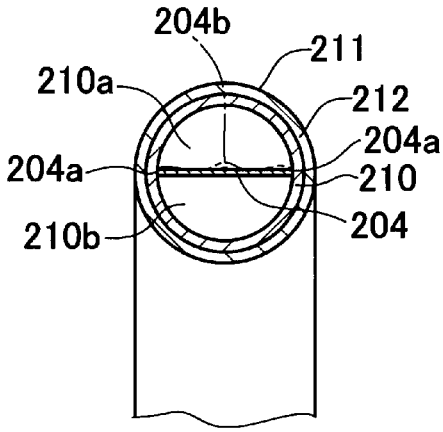
FIG. 9B is a sectional view thereof as seen in a direction of an arrow "b"—"b" in FIG. 8.

The upstream end of the exhaust pipe 210 is left free and the upstream end of the cover member 211 is connected to a flange 206, which is also called a connecting member, by welding the periphery of the cover member 211 to the flange 206. In this manner, the clearance 213 is formed between the periphery of the exhaust pipe 210 and the inner circumference of the cover member 211 as shown in FIG. 9A. The downstream end of the cover member 211 is fixed to the periphery of the exhaust pipe 210 as explained above and as shown in FIGS. 8 and 9B. The high-temperature exhaust gas flows through the exhaust pipe 210 in a manner similar to that in the examples given hereinabove. On the upstream end of the exhaust pipe 210, the partition plate 204 is free to expand in the diametrical direction within the clearance 213. On the other hand, the downstream end of the cover member 212 is fixedly connected to the periphery of the exhaust pipe 210 around the entire circumference as shown in FIG. 9B. Therefore, at this particular portion, the partition plate 204 is restricted in its thermal expansion in the diametrical direction. As a result, the partition plate gives rise to a deformation 104b as shown by dotted lines in FIG. 9B. However, since the thermal expansion at this restricted portion is smaller as compared with that at the upstream endmost portion, the adverse effects on the distribution of the exhaust gas is relatively limited.

Figure 9C:
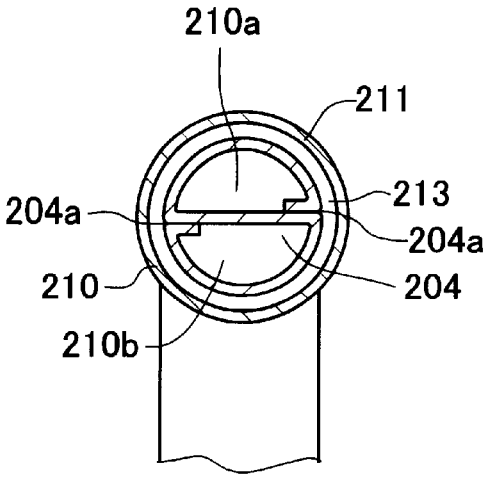
FIG. 9C is a sectional view of another modified example of the present invention as seen in a direction of an arrow "a"—"ea" in FIG. 8.
Figure 9D:
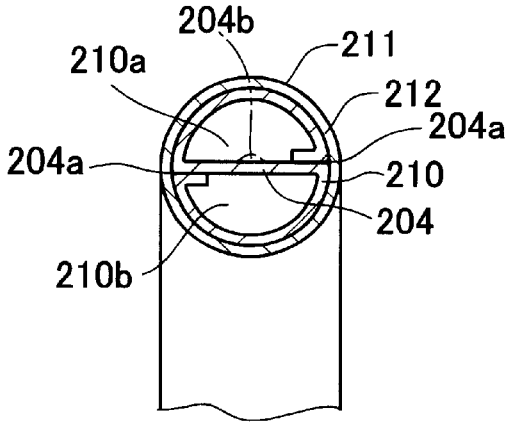
FIG. 9D is a sectional view as seen in a direction of "b"—"b" in FIG. 8.
Figure 10A:
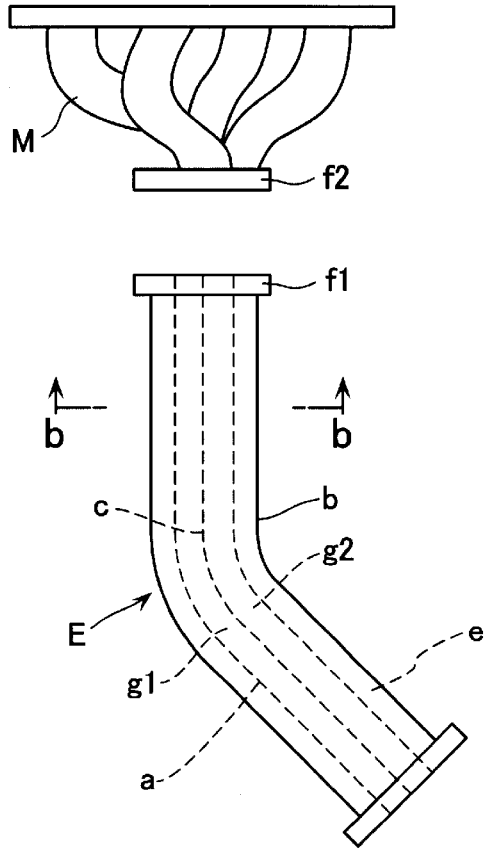
FIG.10A PRIOR ART
FIG. 10A is a front view of a conventional exhaust pipe assembly of two-passage and double-pipe construction.
Figure 10B:
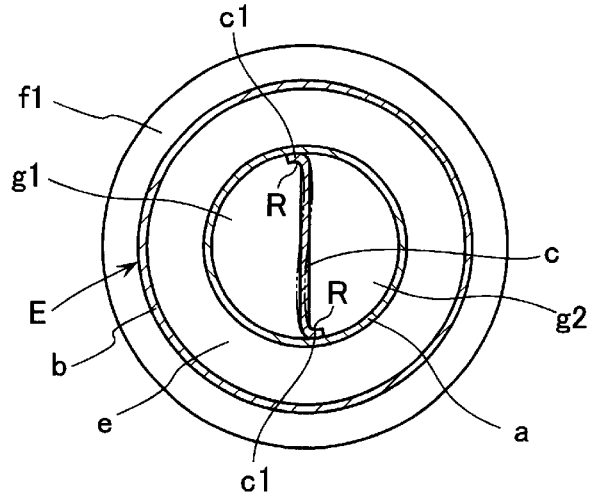
FIG.10B PRIOR ART
FIG. 10B is a sectional view as seen in a direction of "b"—"b" in FIG. 8A.

FIGS. 9C and 9D show another example of the partition plate 204 which is a modification of that in FIGS. 9A and 9B. In this example, the partition plate 204 is formed by a single plate like in the example shown in FIGS. 2 and 3. Therefore, detailed explanations thereof are omitted.

As can be seen from the above-described explanations, according to the present invention, due to the presence of the clearance, the thermal expansion of the partition plate is not disturbed.

It is readily apparent that the above-described exhaust pipe assembly of two-passage construction meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An exhaust pipe assembly of two-passage and double-pipe construction, comprising:

an inner pipe;

a partition plate meeting said inner pipe at both diametrical meeting ends thereof so as to be elongated in a longitudinal direction of said inner pipe, whereby two passages divided across a diameter of said inner pipe are formed;

an outer pipe covering said inner pipe with a thermally insulating space around a periphery of said inner pipe, said outer pipe having on one longitudinal end thereof a connecting portion for connection with a mating member, wherein one end of said inner pipe is fixedly connected to said outer pipe with a clearance between the periphery of said inner pipe near each of said meeting ends and an inner circumference of said outer pipe.

2. The exhaust pipe assembly according to claim 1, further comprising a connecting member provided at said connecting portion, said connecting portion being for connecting said exhaust pipe assembly to the mating member.

3. The exhaust pipe assembly according to claim 1, wherein said inner pipe at said connecting portion is formed into a substantially true circle and wherein said outer pipe at said connecting portion is formed into an ellipse having a larger diameter in a direction of said partition plate, whereby said clearance is formed between said inner pipe and said outer pipe.

4. The exhaust pipe assembly according to claim 2, wherein said inner pipe at said connecting portion is formed into a substantially true circle and wherein said outer pipe at said connecting portion is formed into an ellipse having a larger diameter in a direction of said partition plate, whereby said clearance is formed between said inner pipe and said outer pipe.

5. The exhaust pipe assembly according to claim 1, wherein said inner pipe at said connecting portion is formed into an ellipse having a smaller diameter in a direction of said partition plate and wherein said outer pipe at said connecting portion is formed into a substantially true circle, whereby said clearance is formed between said inner pipe and said outer pipe.

6. The exhaust pipe assembly according to claim 2, wherein said inner pipe at said connecting portion is formed into an ellipse having a smaller diameter in a direction of said partition plate and wherein said outer pipe at said connecting portion is formed into a substantially true circle, whereby said clearance is formed between said inner pipe and said outer pipe.

7. The exhaust pipe assembly according to any one of claims 1 through 6, wherein said inner pipe and said partition plate are formed by a single plate material which is bent substantially into a configuration of an alphabet "S" or of a cocoon in cross section.

8. An exhaust pipe assembly of two-passage and double-pipe construction, comprising:

an inner pipe;

a partition plate meeting said inner pipe at both diametrical meeting ends thereof so as to be elongated in a longitudinal direction of said inner pipe, whereby two passages divided across a diameter of said inner pipe are formed;

an outer pipe covering said inner pipe with a thermally insulating space around a periphery of said inner pipe, wherein said outer pipe has on one longitudinal end thereof a connecting portion for connection with a mating member, and wherein said outer pipe is fixed to the periphery of said inner pipe by a holding portion which lies at a short distance toward a downstream side from said connecting portion while leaving a clearance at said connecting portion between said inner pipe and said outer pipe.

9. The exhaust pipe assembly according to claim 8, wherein said holding portion is formed by reducing a diameter of said outer pipe into close contact with the periphery of said inner pipe.

10. The exhaust pipe assembly according to claim 8, further comprising a connecting member provided at said connecting portion, said connecting portion being for connecting said exhaust pipe assembly to the mating member.

11. The exhaust pipe assembly according to claim 9, further comprising a connecting member provided at said connecting portion, said connecting portion being for connecting said exhaust pipe assembly to the mating member.

12. The exhaust pipe assembly according to any one of claims 8 through 11, wherein said inner pipe and said outer pipe at said connecting portion are concentric with each other.

13. The exhaust pipe assembly according to any one of claims 8 through 11, wherein said inner pipe and said partition plate are formed by a single plate material which is bent substantially into a configuration of an alphabet "S."

14. An exhaust pipe assembly of two-passage construction, comprising:

an exhaust pipe;

a partition plate meeting said exhaust pipe at both diametrical meeting ends thereof so as to be elongated in a longitudinal direction of said exhaust pipe, whereby two passages divided across a diameter of said exhaust pipe are formed;

a cover member surrounding a periphery of one longitudinal end of said exhaust pipe, wherein said cover member is fixedly connected to said exhaust pipe at one end of said cover member with a clearance between the periphery of said exhaust pipe and an inner circumference of said cover member, the other end of said cover member and said one longitudinal end of said exhaust pipe forming a connecting portion for connection with a mating member.

15. The exhaust pipe assembly according to claim 14, wherein said cover member is fixedly connected to said exhaust pipe at that end of said cover member which is on a downstream end of said exhaust pipe.

16. The exhaust pipe assembly according to claim 14, further comprising a connecting member provided at said connecting portion, said connecting portion being for connecting said exhaust pipe to the mating member.

17. The exhaust pipe assembly according to claim 15, further comprising a connecting member provided at said connecting portion, said connecting portion being for connecting said exhaust pipe to the mating member.

18. The exhaust pipe assembly according to any one of claims 14 through 17, wherein said partition plate is formed by a single plate material which is bent substantially into a configuration of an alphabet "S" or of a cocoon in cross section.

* * * * *